US009222677B2

(12) United States Patent
Dora

(10) Patent No.: US 9,222,677 B2
(45) Date of Patent: Dec. 29, 2015

(54) GAS BURNER

(71) Applicant: SABAF S.p.A., Ospitaletto (BS) (IT)

(72) Inventor: Massimo Dora, Ospitaletto (BS) (IT)

(73) Assignee: SABAF S.p. A., Ospitaletto (BS) (IT)

( * ) Notice: Subject to any disclaimer, the term of this patent is extended or adjusted under 35 U.S.C. 154(b) by 189 days.

(21) Appl. No.: 13/813,589

(22) PCT Filed: Oct. 26, 2012

(86) PCT No.: PCT/IB2012/002148
§ 371 (c)(1),
(2) Date: Apr. 9, 2013

(87) PCT Pub. No.: WO2014/064481
PCT Pub. Date: May 1, 2014

(65) Prior Publication Data

US 2014/0116417 A1 May 1, 2014

(51) Int. Cl.

| | |
|---|---|
| ***F24C 3/08*** | (2006.01) |
| ***F23D 14/56*** | (2006.01) |
| ***F23D 14/58*** | (2006.01) |
| ***F23D 14/06*** | (2006.01) |

(52) U.S. Cl.
CPC ..... *F24C 3/08* (2013.01); *F23D 14/065* (2013.01); *F23D 14/56* (2013.01); *F23D 14/58* (2013.01); *F23D 2900/14062* (2013.01)

(58) Field of Classification Search
CPC ..... F23D 11/001; F23D 3/00; F23D 14/00; F24C 3/085; F24C 3/106
USPC ..... 431/285, 278, 283
See application file for complete search history.

(56) References Cited

U.S. PATENT DOCUMENTS

| | | | | |
|---|---|---|---|---|
| 1,151,327 | A * | 8/1915 | Andreas | 431/280 |
| 2010/0291498 | A1* | 11/2010 | Rodriguez-Medina et al. | 431/258 |
| 2011/0143295 | A1 | 6/2011 | Fowler | |
| 2011/0151385 | A1 | 6/2011 | Lona Santoyo et al. | |

FOREIGN PATENT DOCUMENTS

| | | | |
|---|---|---|---|
| WO | 2012/085610 | A1 | 6/2012 |
| WO | 2013/068775 | A1 | 5/2013 |

* cited by examiner

*Primary Examiner* — Steven B McAllister
*Assistant Examiner* — Rabeeul Zuberi
(74) *Attorney, Agent, or Firm* — Lucas & Mercanti LLP.

(57) ABSTRACT

Gas burner having at least two flame spreaders, at least one diffusion chamber between the flame spreaders for the diffusion of a primary air/gas mixture for at least one of the flame spreaders, and at least one cross-lighting duct for the flame passage between the flame spreaders. The duct is disposed transversally inside the diffusion chamber to define a first and a second region in the diffusion chamber and has two side walls and one upper wall, for the fluidic direct connection between the first and the second region of the diffusion chamber. The upper wall has at least one hole for the mixture inflow into the duct and the cross-lighting duct has at least one lower opening facing the upper wall of the cross-lighting duct.

18 Claims, 4 Drawing Sheets

GAS BURNER

CROSS-REFERENCE TO RELATED APPLICATION

This application is a 371 of PCT/IB2012/002148, filed Oct. 26, 2012, the contents of which are incorporated herein by reference.

TECHNICAL FIELD

The present invention concerns a gas burner of the type comprising at least two flame spreaders.

More particularly, the present invention pertains to a gas burner comprising, in addition to the afore said two flame spreaders, also a chamber which is between said two flame spreaders for the diffusion of a primary air/gas mixture for at least one of such flame spreaders.

BACKGROUND OF THE INVENTION

In such a gas burner type, in which usually at least part of said diffusion chamber is made in one piece named "burner head", the use of a cross-lighting duct is known, to allow the flame passage from one to the other of the two flame spreaders and then to avoid the use of more spark plugs for sparking the flame ignition at such two flame spreaders. This duct is disposed transversally inside said first diffusion chamber, passing through it completely, so that to define a first and a second region inside the diffusion chamber.

These gas burners of the known art are not free of drawbacks. As a matter of fact, because of the presence of the afore said cross-lighting duct, separating the diffusion chamber—as mentioned—in two regions fluidically distinct one from another, the diffusion of the primary air/gas mixture inside said diffusion chamber is less uniform, thereby involving problems for the flame maintaining stably and homogeneously at the flame spreaders fed by the diffusion chamber, with subsequent combustion problems for the burner itself.

To improve and make the diffusion of the primary air/gas mixture more uniform inside the diffusion chamber the existence of a burner is known, whose cross-lighting duct has an upper wall disposed lower than the upper dome, usually defined by a removable lid, of the diffusion chamber and such to allow the mixture to communicate in the whole volume of the diffusion chamber, that is also between the first and the second region inside said diffusion chamber.

For example the International Application PCT/IB2011/002629 in the name of the Applicant, and still in obligation of secrecy, describes a solution identical to what afore mentioned.

This solution, although doubtless able to improve the diffusion of the primary air/gas mixture inside the chamber, with evident improving effects on the burner efficiency and the flame stability, nevertheless cannot always guarantee the presence of the gas and the primary and secondary air inside the cross-lighting duct in adapted stoichiometric conditions when the fuel gas type fed to the burner changes, and in particular when the gas is made of mixtures of different ingredients having different concentrations, this resulting in the flame not propagating inside the duct perfectly. Therefore an object of the present invention is to realize a burner allowing the inflow of the mixture and air into the cross-lighting duct in stoichiometric conditions such to guarantee a perfect flame propagation inside the duct.

A further object of the present invention is to realize a burner being also structurally simple and not requiring particular assembling procedures and modifications in existing burners.

Further object of the present invention is to realize a burner that, in addition to allow achieving the object afore mentioned, could be assembled with a certain adaptability according to the gas, or gas mixture, amount and type, feeding the burner and/or according to the sizes of the burner to be made.

SUMMARY OF THE INVENTION

These objects are attained by the gas burner of the type comprising at least two flame spreaders, at least one diffusion chamber placed between said at least two flame spreaders for the diffusion of a primary air/gas mixture for at least one of said at least two flame spreaders, and at least one cross-lighting duct for the flame passage between said at least two flame spreaders, said at least one cross-lighting duct being disposed transversally inside said at least one diffusion chamber so that it defines a first and a second region in said at least one diffusion chamber, and comprising two side walls and one upper wall for the fluidic direct connection between said first and said second region of said at least one diffusion chamber, said upper wall being provided with at least one hole for the mixture inflow into said at least one cross-lighting duct, characterized in that said at least one cross-lighting duct comprises on below at least one lower opening, facing at least in part said upper wall of the cross-lighting duct, which in case can be choked.

Advantageously, said at least one lower opening allows the inflow of a proper secondary air amount to aid the flame propagation inside said cross-lighting duct. In addition, said at least one lower opening may be arranged to be closed at least in part, and therefore able to be choked, that is to be reduced in the surface extent in case the supply of secondary air is less than what initially supposed.

Further, said at least one duct comprises at least one closing element, which can be combined to said at least one lower opening, preferably in a removable way, to cover said at least one lower opening only partially. Alternatively, said at least one duct comprises at least one closing element which can be combined to said at least one lower opening, preferably in a removable way, to cover the latter completely.

Then, according to the invention, such a closing element could have a surface extent such to reduce the opening section, or area, considerably or, at worst, to cover said opening section, or area, completely and then to reduce, or prevent, the secondary air intake into said cross-lighting duct.

This solution is extremely advantageous because, during the burner assembling step and based on the burner design, the size thereof, the gas type feeding the burner and the type of flame propagation to be achieved, it allows to change conveniently the passage area of secondary air through said at least one lower opening, simply changing the surface extent of the sheet combined with the opening. At worst, according to the above describe embodiment, such a closing element could also not be present.

Such a closing element comprises, according to an embodiment of the invention, at least one sheet which could comprise, as well, at least one elongate passage which, when it is not covering said at least one lower opening totally, could cover only a part thereof to reduce the passage section for the secondary air through the lower opening itself.

Such a sheet could preferably be obtained by shearing and be made of steel, otherwise of die-cast aluminum.

Still according to an aspect of the present invention, said at least one elongate passage of said at least one sheet and said at least one hole of said upper wall are reciprocally disposed in not-superimposed positions. In fact the Applicant noticed that this produces an unexpected and amazing improvement of the mixture flow through the cross-lighting duct.

It has to be further observed that said burner could preferably comprise a burner head on which at least part of the distribution chamber is obtained and the upper and side walls of said cross-lighting duct could be attached, or obtained as a whole, and on which the afore said lower opening of such a cross-lighting duct could be present. The burner head, as usual, is engaged when rested with a respective constrainable cup to a hob and it defines, with the cup, at least one or more inflow passages of the secondary air directed towards the lower opening of said cross-lighting duct. In this way said at least one sheet—when present—could be arranged in combination with said at least one lower opening of the duct, and then it could be arranged between said cup and said at least one cross-lighting duct, when the burner is assembled.

In addition, according to a preferred aspect of the invention, said burner head could be provided with perimeter seats to receive said rested sheet in order to constrain it therewith.

Still according to an embodiment of the invention, said at least one upper wall and said side walls of said cross-lighting duct are obtained as a whole. In addition, said at least one distribution chamber and said at least one cross-lighting duct are obtained as a whole too in order to obtain said burner head.

At last, according to a particular embodiment of the invention, said two flame spreaders are circular, said at least one diffusion chamber has a ring shape and said at least one cross-lighting duct is disposed radially with respect to said at least one diffusion chamber.

BRIEF DESCRIPTION OF THE FIGURES

For purposes of illustrations and not limitative, more particular preferred embodiments of the present invention will be now provided with reference to the accompanying figures, in which.

DETAILED DESCRIPTION OF SOME EMBODIMENTS OF THE PRESENT INVENTION

Referring particularly to such figures, with the numeral 1 a gas burner according to a particular aspect of the present invention is shown.

Figure 1A:
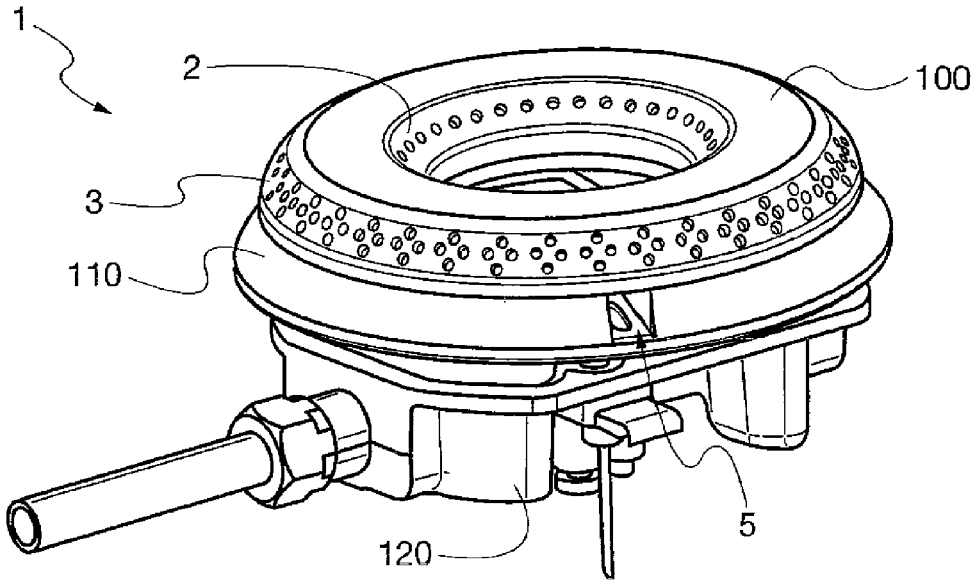
FIG. 1*a* is a perspective view of a gas burner according to the invention.
Figure 1B:
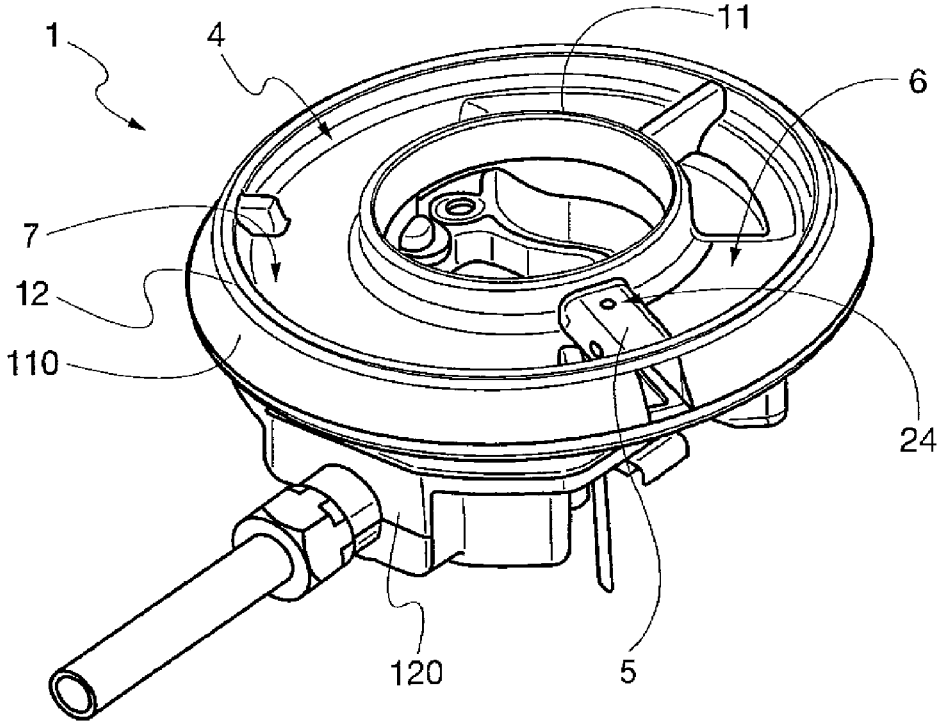
FIG. 1*b* is a top perspective view of a gas burner according to the invention, without the two flame spreaders.
Figure 2:
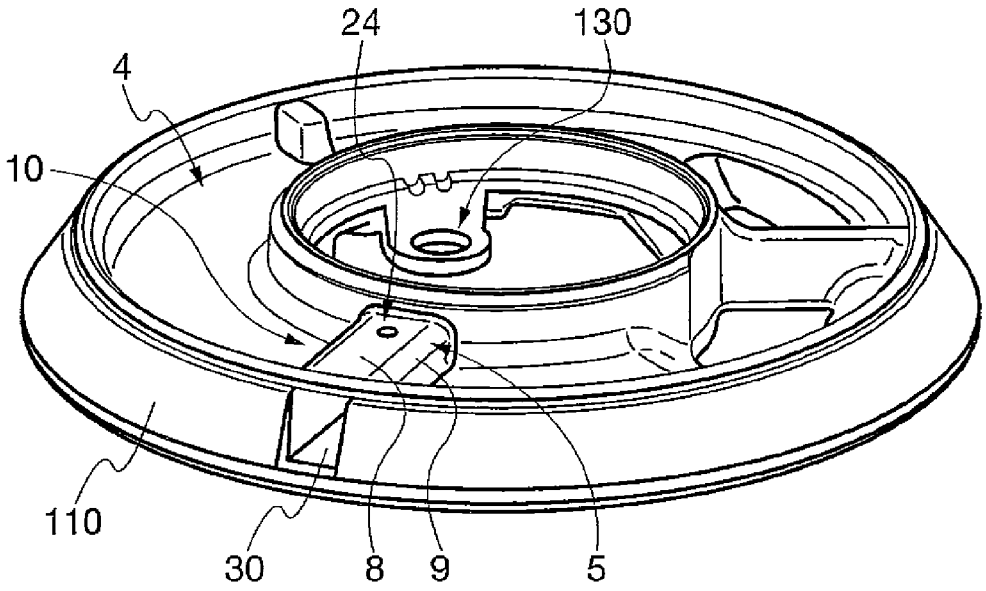
FIG. 2 is a top perspective view of the burner head of FIG. 1, comprising the distribution chamber, in which the lower opening of the cross-lighting chamber is shown.

Referring to FIGS. 1 and 2, such a gas burner 1 comprises two flame spreaders 2, 3, joined one to another by a top closure, or lid, 100, integral therewith, a head 110 of the burner comprising at least part of a chamber 4 obtained between the two flame spreaders 2, 3 for the diffusion of a primary air/gas mixture for said two flame spreaders 2, 3, and a cup 120, adapted to be constrained to the hob of a cooking equipment and on which such a head 110 of the burner is engaged at least by resting. Further said gas burner 1 comprises a cross-lighting duct 5 for the passage of the flame between said two flame spreaders 2 and 3.

The cross-lighting duct 5 which in the particular embodiment herein shown is developed substantially along a straight line disposed transversally with respect to the chamber 4, provides at its end two open sections for the entering and exiting of the flame, so as to allow the latter to pass from one side to the other of the chamber 4.

Particularly, in the specific case herein examined, the flame is firstly ignited by the ignition spark plug at the inner flame spreader 2 (see the seat 130 inside which such a spark plug is constrained) and, subsequently, such a flame is transferred by said cross-lighting duct 5 to the outer flame spreader 3 for ignition at the latter of the flame.

It has to be noticed that it is sufficient to change the arrangement of the ignition spark plug to have the flame passing oppositely, from the outer to the inner flame spreader, without any need to modify the shape of the cross-lighting duct 5.

Such a cross-lighting duct 5 is disposed transversally inside said first diffusion chamber 4 so that to define a first 6 and a second 7 region inside such a diffusion chamber 4.

According to a herein described embodiment, the afore said two flame spreaders 2, 3 are circular, the diffusion chamber 4 has substantially a ring shape and the cross-lighting duct 5 is disposed radially with respect to the afore said annular diffusion chamber 4. In addition, the two flame spreaders 2, 3 are combined with the upper perimeter ends 11, 12, respectively inside and outside, of said diffusion chamber 4. In other embodiments herein not shown, the upper perimeter ends 11, 12 of such a diffusion chamber 4, and then the head 110 of the burner, could also comprise the afore said flame spreaders 2 and 3, integral (attached) thereto or obtained as a whole, which are in this case without the lid 100, that could be in this case made as a separated element, without for this reason exiting from the protection scope of the present invention.

It has to be observed that, although so far it has been described a burner 1 having an annular shape and comprising two flame spreaders and an annular diffusion chamber, however an embodiment wherein said two flame spreaders are, for example, straight as the diffusion chamber itself, falls again within the protection scope of the present invention.

It falls in the protection scope herein demanded as well, for example, a burner provided with at least one first flame spreader fed by a first annular diffusion chamber and at least one second flame spreader, fed by a second circular diffusion chamber, placed in the center and coaxially to the first annular diffusion chamber, as it could happen in case of burners with flame spreaders that could be fed separately.

As can be seen in the appended figures, and as already mentioned, the diffusion chamber 4 in the herein illustrated burner 1 is defined by a substantially toroidal body with a U shaped section, belonging to the afore said head 110 of the burner. Based on the arrangement shown before, the two regions 6 and 7 of said diffusion chamber 4 are substantially geometrically separated one from another by the cross-lighting duct 5, although not from a fluid dynamic point of view. In fact, said cross-lighting duct 5 comprises two side walls 9, 10 separated one from another and an upper wall 8, placed far from the dome of the diffusion chamber 4, composed by a lid 100 of the flame spreaders 2, 3, allowing the direct fluidic connection between said first 6 and said second 7 region of said diffusion chamber 4.

In concrete terms, such an upper wall 8, that could be made as a whole with said side walls 9, 10 on the head 110 of the burner, defines a passage section with the lower surface of the afore said lid 100 for the primary air/gas mixture present in the diffusion chamber 4.

The primary air/gas mixture is then able to pass between said first and second regions 6 and 7 of said diffusion chamber 4 with no difficulties, thereby increasing the flame stability at the flame spreaders 2, 3 and then entailing a higher efficiency degree of combustion.

In concrete terms, the two transversally radially extended walls 9, 10, made preferably integrally with said diffusion chamber 4 in said head 110 of the burner, necessarily have—because of what mentioned—a lower height at the elevation at which the lid 110 of the flame spreaders 2, 3 is, with respect to the bottom wall of the diffusion chamber 4, just for allowing the passage of said mixture between the lid 110 of the upper wall 8 of the cross-lighting duct 5.

According to an embodiment herein described, said upper wall 8 of the duct 5 is also provided with a hole 24 to guarantee the inflow of primary air/gas mixture into the same cross-lighting duct 5.

Still according to an embodiment herein described, and as can be better seen in FIG. 2, said cross-lighting duct 5 comprises, in addition to its sections for the entering and exiting of the flame, placed substantially orthogonal to the axis according to such a duct extends, a lower opening 30 for the passage of the secondary air, substantially facing, at least in part, the afore said upper wall 8 of the same cross-lighting duct 5. Advantageously, as a matter of fact, being such an opening 30 in fluidic communication with the outer environment, thanks to the geometry of the upper surface of the head 110 of the burner and the respective cup 120, it allows an appropriate passage of secondary air inside the cross-lighting duct 5, so that to guarantee a proper combustion of the flame inside the duct 5 itself.

It has to be noticed that the upper wall 8 and the side walls 9, 10 of the cross-lighting duct 5, which could have an inverted "U" shaped section thanks to the lower opening 30, could become integral or could be obtained as a whole with the head 110 of the burner, for example providing as well the carrying out, as a whole or by removal after the molding, of the afore said lower opening 30 in such a head 110 of the burner.

It has to be observed as well that the shape of the cup 120 and the head 110 of the burner, and in particular of the surface of the head 110 opposite from the surface the chamber 4 is placed on, allows to define access passages for the secondary air which are directed towards the opening 30, once the head 110 is engaged with the cup 120 of the burner 1.

As can be seen, the lower opening 30 of the cross-lighting duct 5 could be choked thanks to the use of a closing element 31 able to occlude it even also partially.

In FIGS. 1*a* and 1*b* said burner 1 is then provided with a closing element 31 preferably, but not exclusively, removable, combined with said opening 30, and having such a surface extent to change the flow rate of secondary air passing through said opening 30.

However it has to noticed that an embodiment without such a closing element 31, that is in which there is the only opening 30 disposed below said cross-lighting duct 5, substantially facing the afore said upper wall 8 of the latter, still falls in the protection scope of the present invention.

It has to be noticed as well that, although the preferred constraining mode of the afore said closing element 31, if present, is of removable type, also permanent constraints, such as for example the welding, or molding as a whole with the burner head, still falls in the protection scope of the present invention.

According to an embodiment shown in FIGS. 1*a* and 1*b*, such a closing element 31, comprising preferably a steel sheet, sheared for example, covers only in part said opening 30, i.e. it has a surface extent smaller than that of the afore said lower opening 30 of the cross-lighting duct 5.

Figure 3:
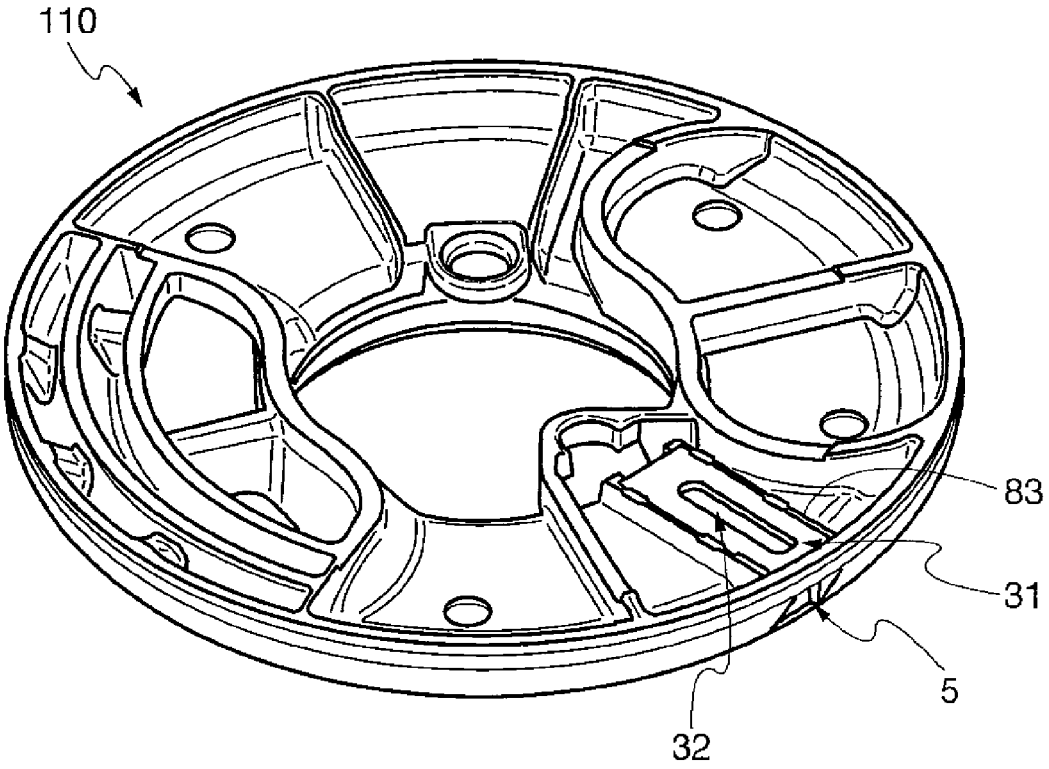
FIG. 3 is a bottom perspective view of the burner head of FIG. 1 on which a closing element provided with an elongate passage is provided.

In particular such a sheet 31, better seen in FIG. 3, is combined with the head 110 of the burner and it comprises a longitudinally elongate passage 32. When the head 110 of the burner, and then the distribution chamber 4, is assembled to the cup 120, said sheet 31 is then arranged between the cup 120 and the head 110 of the burner, or better between the cup 120 and the upper wall 8 and the side walls 9, 10 of the cross-lighting duct 5, and then it allows the precise passage of secondary air from the outer environment, thanks to said access passages defined by the geometry of cup 120 and head 110 of the burner, inside the cross-lighting duct 5, thanks to the elongate passage 32.

In this embodiment, said elongate passage 32 is arranged, with respect to said hole 24 of the upper wall 8 of the cross-lighting duct 5, so that it is not in a position facing, that is superimposed, to said elongate passage 32, that is to say so that the projection of the hole 24 on the plane on which said elongated passage 32 lies, that is on the plane of the sheet 31, does not fall inside said elongate passage 32. Such a solution, as afore said, improves the circulation of primary air/gas mixture inside the cross-lighting duct 5.

It has to be observed that the head 110 of the burner is provided as well of convenient perimeter seats 83, to receive said sheet 31 when rested, and then to allow a stable constraint, so that it is easy the assembling of the sheet 31 on the head 110 of the burner and that, when the burner 1 is assembled, such a sheet 31 is combined firmly with said opening 30 of said cross-lighting duct 5. Such perimeter seats 83, specifically obtained as a whole with said head 110 of the burner, could in substance comprise retaining walls for such a sheet 31.

As mentioned, the access of secondary air towards the opening 30, and then inside the duct 5, is allowed by the particular shape of the lower surface of the head 110 of the burner and the respective cup 120, allowing to define communication passages for the secondary air just leading to the duct 5. And obviously, the flow rate of secondary air reaching the cross-lighting duct 5 is a function of the surface extent of the area remained free in the opening 30 of the foil 31 and of the geometry of said area.

Figure 4:
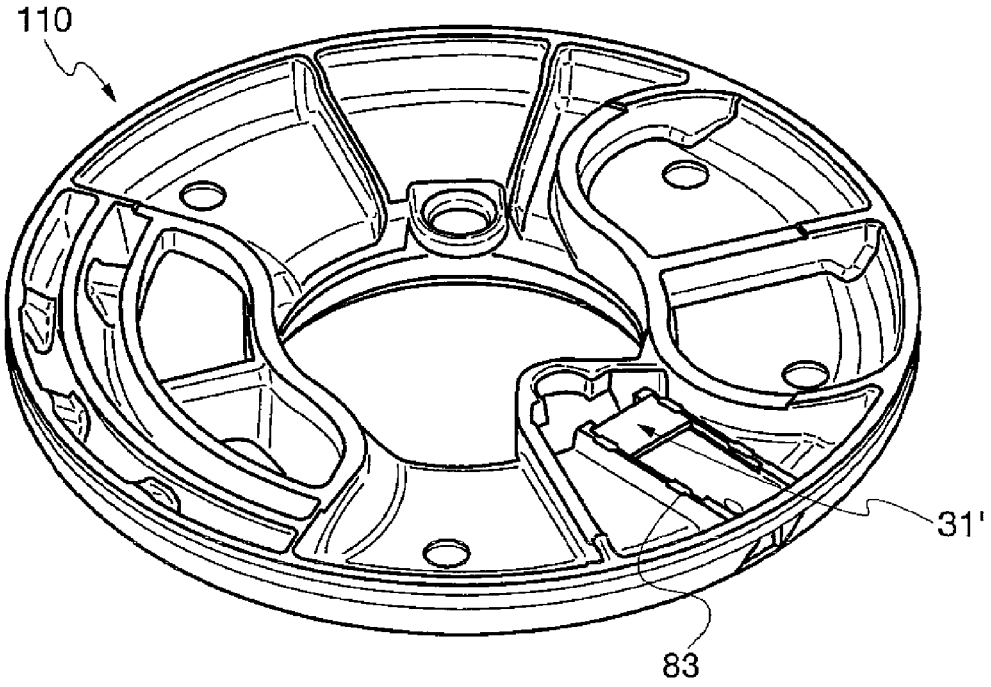
FIGS. 4 and 5 shown a bottom perspective view of further embodiments of the invention in which, at the burner head of FIG. 1, there are closing elements covering the opening of the cross-lighting duct only partially when the burner is assembled.

Again, according to a further embodiment of the invention shown in FIG. 4, the sheet 31' covers said opening 30 only partially because it has a surface extent smaller than that of said opening 30.

Figure 5:
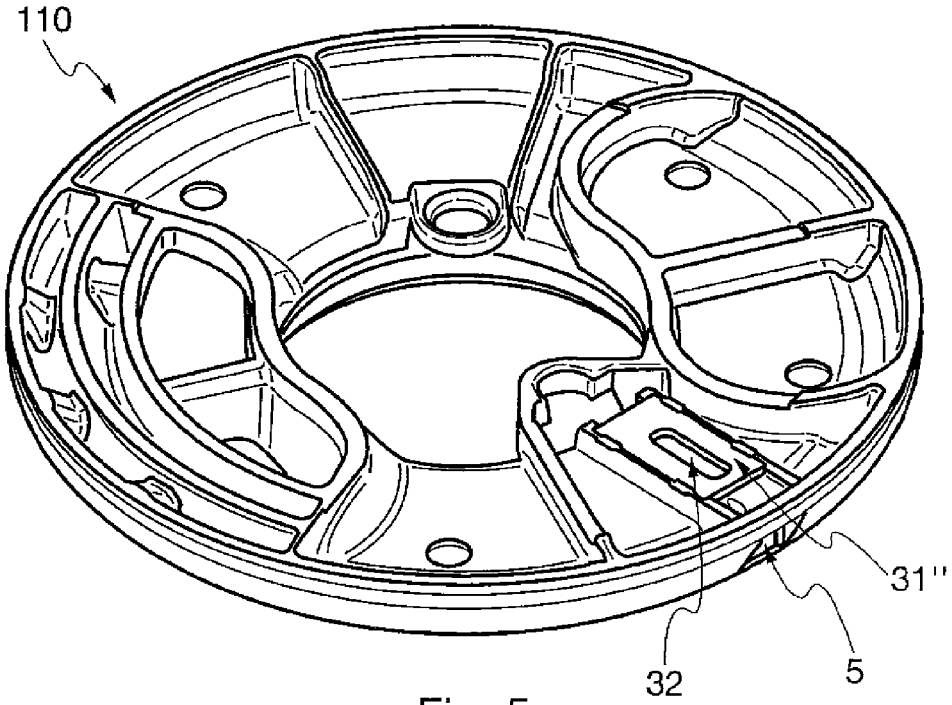

In FIG. 5 a sheet 31" is shown which, as in previous cases, covers only partially said opening 30, however in the shown embodiment such a sheet 31" has not only a surface extent smaller than that of the opening 30, but it comprises an elongate passage 32 too.

Figure 6:
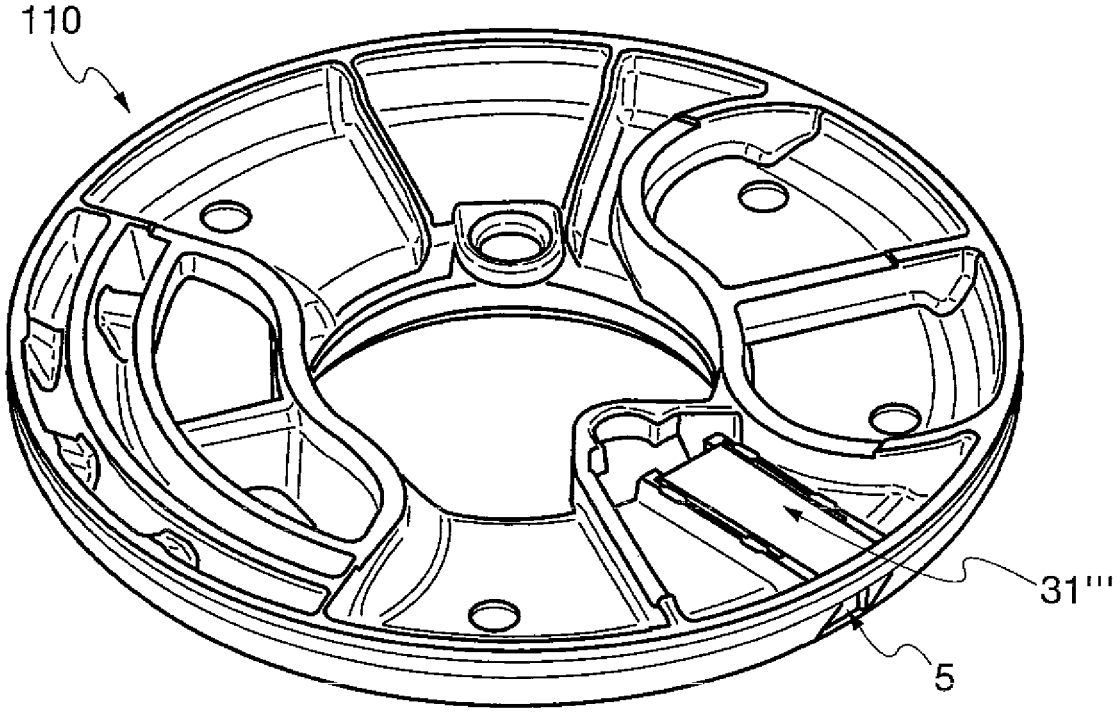
FIG. 6 is a bottom perspective view of an embodiment of the invention in which, at the burner head of FIG. 1, a closing element is disposed covering totally the opening of the cross-lighting duct when the burner is assembled.

In addition, according to an embodiment of the invention shown in FIG. 6, the sheet 31" covers the opening 30 of the cross-lighting duct 5 totally. Such a solution may be adopted advantageously in case wherein it is not necessary to have an addition inflow of secondary air into the cross-lighting duct 5.

In this case, in fact, differently from the afore described embodiments, in which it was always necessary providing an inflow of secondary air into the cross-lighting duct 5, there is the extreme case wherein it is not necessary to provide any kind of secondary air flow rate inside the cross-lighting duct 5, in addition to the air which is naturally at the inlet and outlet sections of the flames.

It has to be observed that the afore described sheets 31, 31', 31", and 31''', simply realized by shearing and made of steel or other metallic material, or alternatively also realized by die-cast aluminum, or other material able to have a similar function, allow not only the assembling of the burner simply and quickly, but also the easily changing of the passage shape and area of the opening 30 based on the gas, or gas mixture, feeding the burner, and/or the type and dimensions of the selected burner, the flow rate of available gas, the type of desired flame propagation and all factors which are relevant for propagating the flame into the cross-lighting duct 5 or else the burner efficiency. This allows to obtain a great adaptability during the assembling of the burner 1, because of having different components, that is closing elements 31, 31', 31" and 31''', able to cause different effects on the flame combustion inside the cross-lighting duct 5.

The invention claimed is:

1. Gas burner of the type comprising at least two flame spreaders and a lid, the at least two flame spreaders and the lid forming an annular dome, at least one diffusion chamber between said at least two flame spreaders for the diffusion of a primary air/gas mixture for at least one of said at least two flame spreaders, and at least one cross-lighting duct for the flame passage between said at least two flame spreaders, said at least one duct being disposed transversally inside said at least one diffusion chamber so that to define a first and a second region in said at least one diffusion chamber and comprising two side walls and one upper wall defining a passage for the fluidic direct connection between said first and said second region of said at least one diffusion chamber, said upper wall extending from the sidewalls across the duct and being placed at a distance from the dome of the diffusion chamber and being provided with at least one hole for the inflow of said primary air/gas mixture into said cross-lighting duct, wherein said at least one cross-lighting duct comprises at least one lower opening facing said upper wall, the at least one lower opening including at least one closing element, and the closing element comprises at least one sheet.

2. Burner according to claim 1, wherein said at least one lower opening can be choked.

3. Burner according to claim 2, wherein said at least one closing element can be combined with said at least one lower opening to cover said at least one lower opening at least partially.

4. Burner according to claim 3, wherein said at least one cross-lighting duct comprises at least one closing element which can be combined to said at least one lower opening to cover said at least one lower opening completely.

5. Burner according to claim 3, wherein said at least one closing element has a surface extent smaller than that of said least one lower opening.

6. Burner according to claim 5, wherein said at least one closing element comprises at least one elongate passage.

7. Burner according to claim 6, wherein said at least one elongate passage and said at least one hole of said upper wall are reciprocally disposed in not-superimposed positions.

8. Burner according to claim 3, wherein said at least one closing element is removably combined with said at least one lower opening of said at least one cross-lighting duct.

9. Burner according to claim 1, wherein said at least one sheet is obtained by shearing.

10. Burner according to claim 1, wherein said at least one sheet is made of steel or aluminum.

11. Burner according to claim 1, wherein further comprising a burner head on which at least part of the distribution chamber is obtained, and a respective cup on which said burner head is engaged at least by resting, said upper and side walls of said cross-lighting duct are fixed to, or obtained as a whole with, said burner head, and that said burner head and said respective cup when engaged one to another, define one or more inflow passages of the secondary air leading to the lower opening of said cross-lighting duct.

12. Burner according to claim 11, wherein said burner head is provided with perimeter seats to receive said closing element.

13. Burner according to claim 1, wherein said at least one upper wall and said side walls of said at least one cross-lighting duct are obtained as a whole.

14. Burner according to claim 1, wherein said at least one diffusion chamber and said at least one cross-lighting duct are obtained as a whole.

15. Burner according to claim 14, wherein said upper perimeter ends of said at least one diffusion chamber comprise at least one of said at least two flame spreaders.

16. Burner according to claim 1, further comprising an upper lid which can be combined with at least one of said at least two flame spreaders.

17. Burner according to claim 1, wherein said two flame spreaders are circular, said at least one diffusion chamber has a ring shape and said at least one cross-lighting duct is disposed radially with respect to said at least one diffusion chamber.

18. Burner according to claim 1, wherein an igniter is arranged outside of the at least one cross-lighting duct.

* * * * *